US008035564B2

(12) United States Patent
Yang et al.

(10) Patent No.: US 8,035,564 B2
(45) Date of Patent: Oct. 11, 2011

(54) SURFACE MOUNTED PLANAR ANTENNA APPARATUS

(75) Inventors: Tsai-Yi Yang, Tainan Hsien (TW); Ching-wen Wu, Tainan Hsien (TW); Wei-Hung Hsu, Tainan Hsien (TW); Te-Yi Chu, Tainan Hsien (TW)

(73) Assignee: Cirocomm Technology Corp., Tainan (TW)

( * ) Notice: Subject to any disclaimer, the term of this patent is extended or adjusted under 35 U.S.C. 154(b) by 352 days.

(21) Appl. No.: 12/325,481

(22) Filed: Dec. 1, 2008

(65) Prior Publication Data

US 2010/0134357 A1 Jun. 3, 2010

(51) Int. Cl.
*H01Q 1/36* (2006.01)

(52) U.S. Cl. ..... 343/700 MS

(58) Field of Classification Search ..... 343/700 MS, 343/713

See application file for complete search history.

(56) References Cited

U.S. PATENT DOCUMENTS

| | | | | |
|---|---|---|---|---|
| 7,075,490 | B2 * | 7/2006 | Noro | 343/713 |
| 7,432,864 | B1 * | 10/2008 | Yang et al. | 343/700 MS |
| 7,498,991 | B2 * | 3/2009 | Chu et al. | 343/702 |
| 2003/0052755 | A1 * | 3/2003 | Barnes et al. | 333/260 |

* cited by examiner

*Primary Examiner* — Tan Ho

(74) *Attorney, Agent, or Firm* — Chun-Ming Shih; HDLS IPR Services

(57) ABSTRACT

A surface mounted planner antenna apparatus includes an antenna and a circuit board. The antenna includes a base, a radiation metal plate arranged on a top face of the base, and a ground metal plate arranged on a bottom face of the base. A through hole is defined from the radiation metal plate and passed through the base to the ground metal plate. A signal feeder is arranged in the through hole and electrically connected to the radiation metal plate but electrically insulated with the ground metal plate. The circuit board is attached on the bottom face of the base and includes an upper face and a lower face, the upper face includes an area for binding with the ground metal plate on the bottom face of the base, and the lower face includes a first pad and a signal feeding trace electrically connected with the signal feeder.

7 Claims, 7 Drawing Sheets

SURFACE MOUNTED PLANAR ANTENNA APPARATUS

BACKGROUND OF THE INVENTION

1. Field of the Invention

The present invention relates to an antenna, in particular to a surface mounted planar.

2. Description of Related Art

Wireless communication products have already become a part of our life, which can be installed in car, public communication equipment or a portable communication apparatus. An antenna installed in such communication products is used to receive and emit electromagnetic waves, which couples electromagnetic energy between free space and guiding device as a basic function. Many different kinds of antennas such like dipole antenna, planar antenna and micro stripe antenna are developed to meet requirements from different kinds of communication products.

FIGS. 1(*a*) and 1(*b*) show a prior art pin through hole type planar antenna 10, which includes a ceramic base 101, a radiation metal plate 102 arranged on a top face of the ceramic base 101, and a ground metal plate 103 arranged on a bottom face of the ceramic base 101. Further, a through hole 104 is formed from the radiation metal plate 102 through the ceramic base 101 to the ground metal plate 103 and is used to accommodate a T-shaped signal feeder 105 to form a planar antenna structure which is able to mount on a mother board. But this kind of pin through hole type planner planar antenna 10 needs to be manually mounted onto the mother board instead of using automatic machine.

Moreover, a surface mounted patch antenna 30 as FIGS. 2(*a*) and 2(*b*) show, includes a ceramic base 301, a radiation metal plate 302 arranged on a top face of the ceramic base 301, a ground metal plate 303 arranged on a bottom face of the ceramic base 301, and at least one metal electrode 304 arranged on a lateral side face of the ceramic base 301. This kind of patch antenna 30 can be mounted onto the mother board by using automatic machine. However, uniform welding temperature is difficult to achieve for ceramic base 301 with considerable size due to temperature characteristics in surface mount process. This makes surface mounting process troublesome for the surface mounted patch antenna 30.

SUMMARY OF THE INVENTION

The present invention is to provide a surface mounted planar antenna apparatus, capable of being electrically connected to a mother board of an electronic device by surface mounting techniques to increase the efficiency of assembling of the antenna apparatus and to improve the convenience of using the antenna apparatus.

In order to achieve aforementioned purpose, the present invention provides a surface mounted planar antenna apparatus, including an antenna and a circuit board. The antenna includes a base, a radiation metal plate arranged on a top face of the base, and a ground metal plate arranged on a bottom face of the base. A through hole is defined from the radiation metal plate through the base to the ground metal plate. The antenna further includes a signal feeder arranged in the through hole and electrically connected to the radiation metal plate but electrically isolated with the ground metal plate. The circuit board is attached on the bottom face of the base and includes a upper face, a lower face and a via hole, wherein the upper face includes at least one binding area for binding with the ground metal plate on the bottom face of the base, and the lower face includes at least one first pad and a signal feeding trace electrically connected with the signal feeder.

BRIEF DESCRIPTION OF THE DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

A detailed description of the present invention will be made with reference to the accompanying drawings.

Figure 1A:
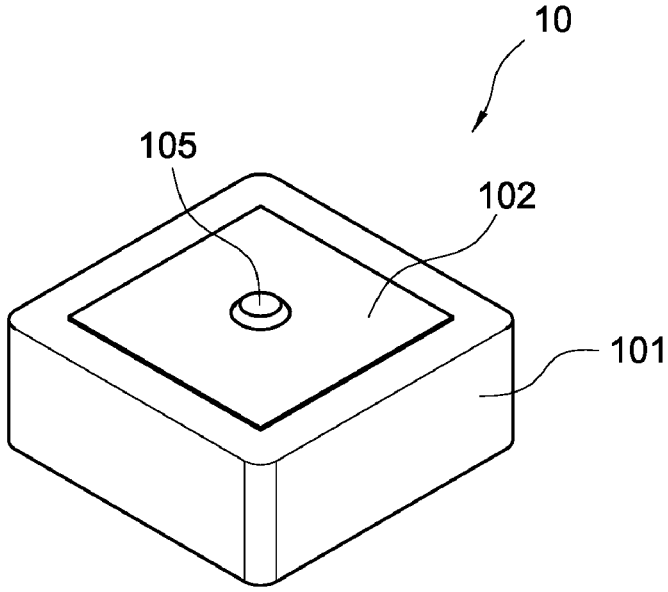
FIG.1a (Prior Art)
FIGS. 1(*a*) and 1(*b*) are perspective views of a traditional pin through hole type planar antenna.
Figure 1B:
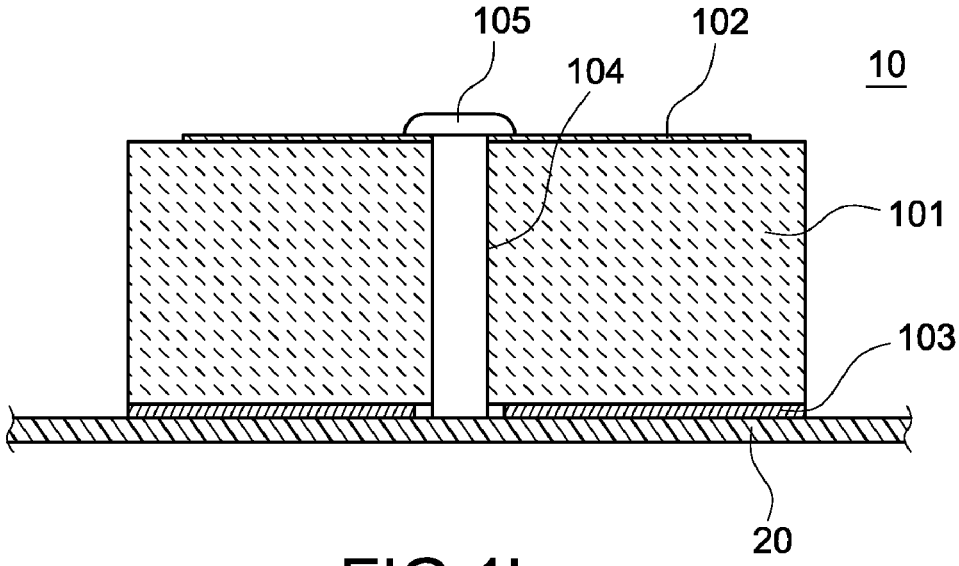
FIG.1b (Prior Art)
Figure 2A:
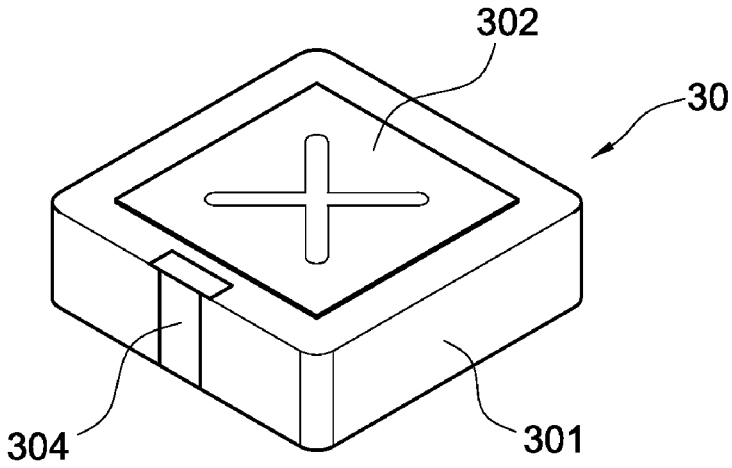
FIG.2a (Prior Art)
FIGS. 2(*a*) and 2(*b*) are perspective views of a prior art surface mounted patch antenna.
Figure 2B:
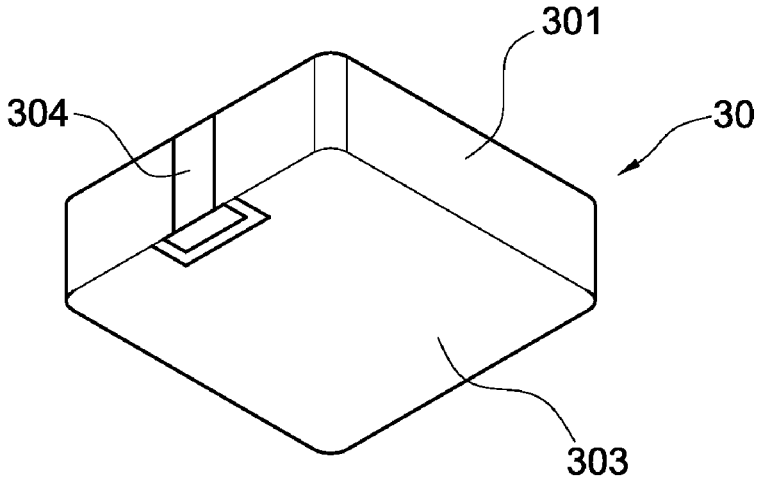
FIG.2b (Prior Art)
Figure 3:
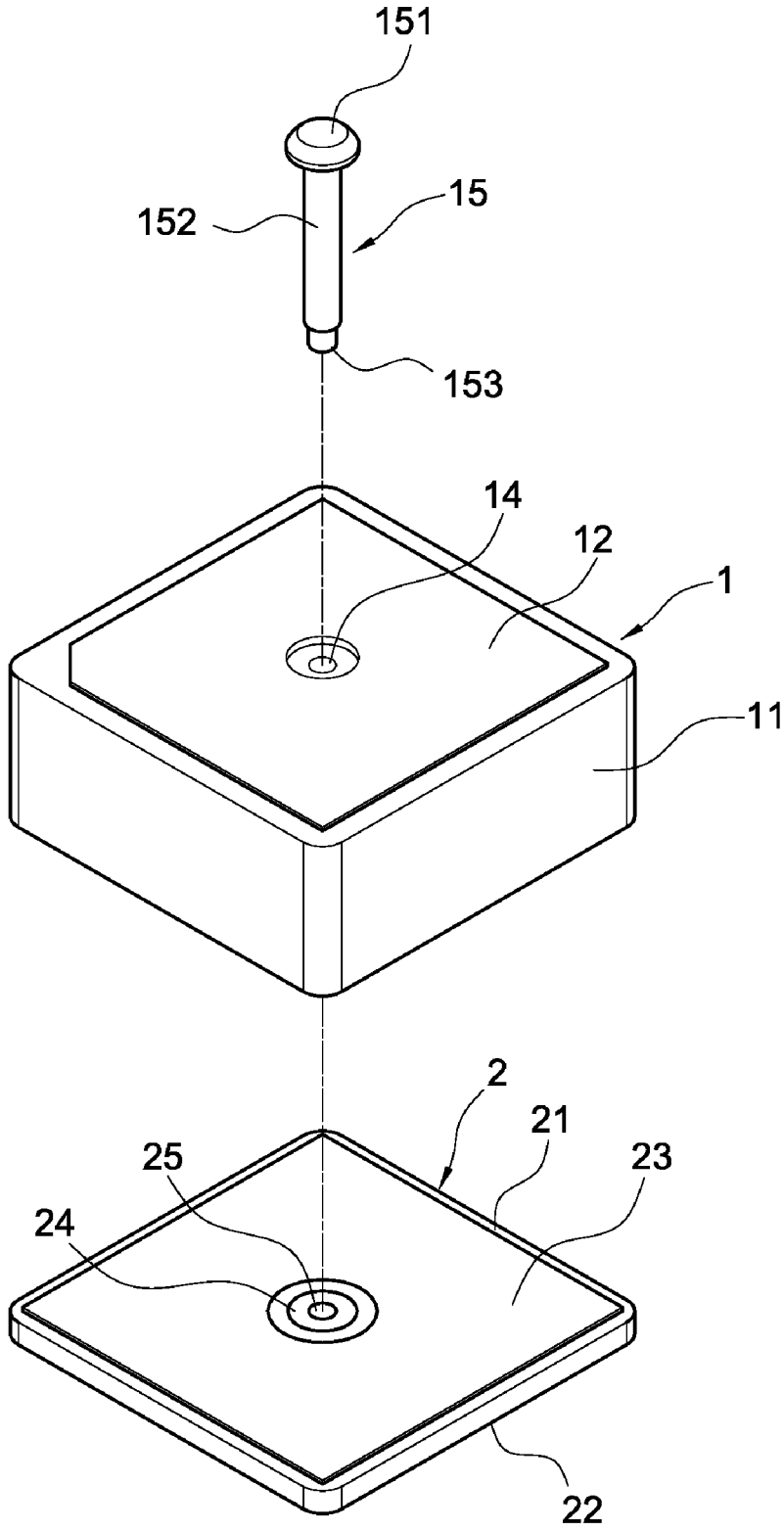
FIG. 3 is a perspective view of a surface mounted planar antenna apparatus of the present invention.
Figure 4:
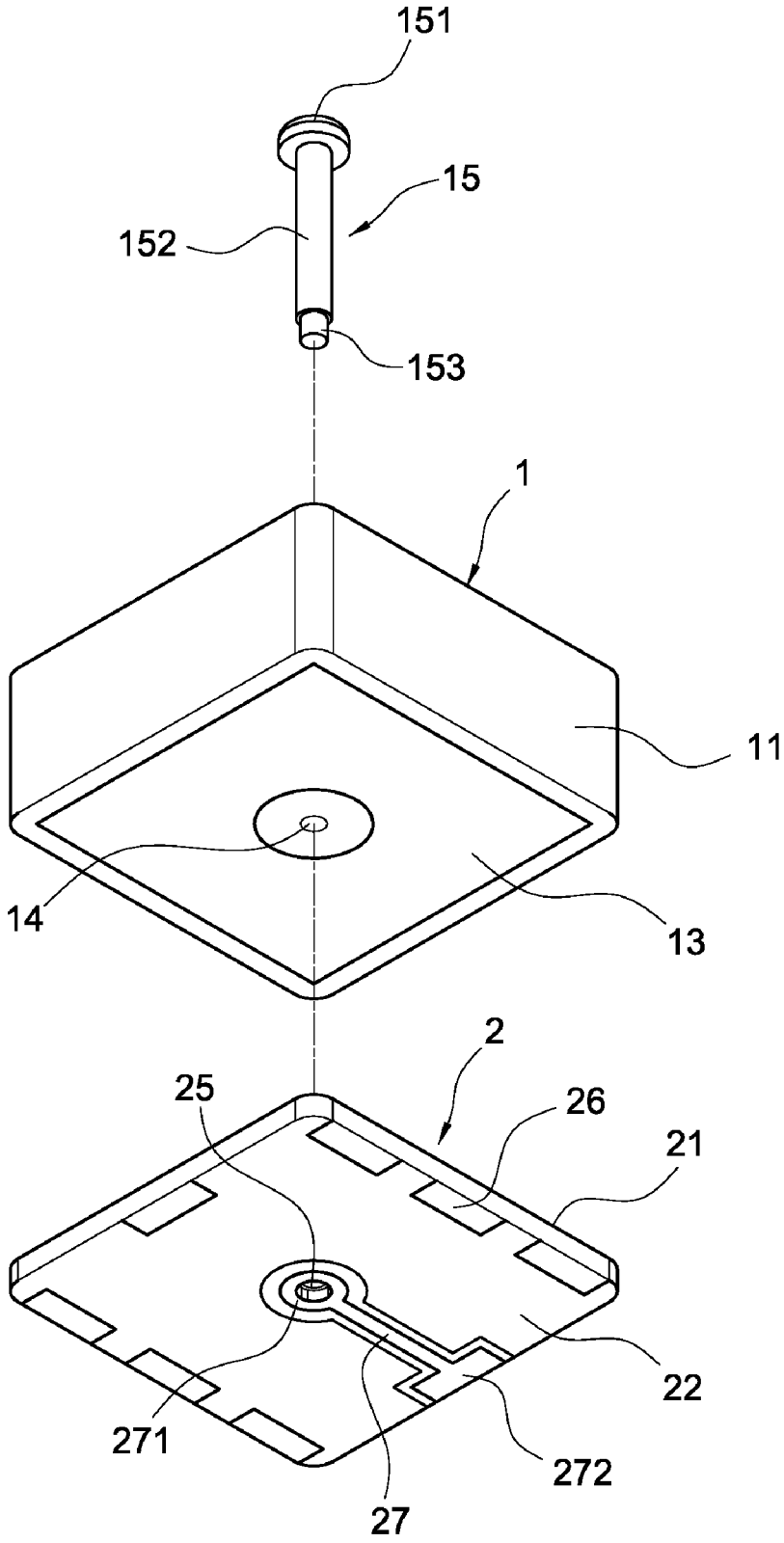
FIG. 4 is another perspective view of a surface mounted planar antenna apparatus of the present invention.
Figure 5:
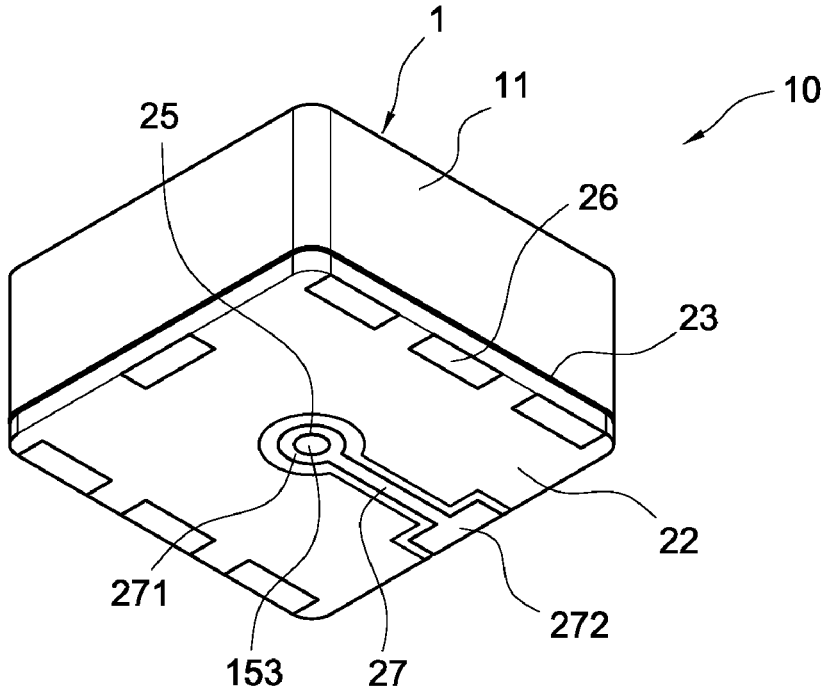
FIG. 5 is another perspective view of a surface mounted planar antenna apparatus of the present invention.

FIGS. 3, 4 and 5 depict a surface mounted planar antenna apparatus according to an embodiment of the present invention. The surface mounted planar antenna apparatus includes an antenna 1 and a circuit board 2. The antenna 1 is substantially cubic shaped and includes a ceramic base 11, a radiation metal plate 12 arranged on a top face of the base 11, and a ground metal plate 13 arranged on a bottom face of the base 11. A through hole 14 is defined from the radiation metal plate 12 through the base 11 to the ground metal plate 13. The antenna 1 further includes a T-shaped signal feeder 15 arranged in the through hole 14. The T-shaped signal feeder 15 includes a semi-circle shaped head 151 electrically connected to the radiation metal plate 12, and a rod 152 extended from the head 151 into the through hole 14. The head 151 is electrically connected with the radiation metal plate 12 which is formed as a signal receiving end. The rod 152 is electrically insulated with the ground metal plate 13 and electrically connected with the circuit board 2.

The circuit board 2 is attached on the bottom face of the base 11 and includes an upper face 21 and a lower face 22. The upper face 21 includes at least one binding area 23 for binding the ground metal plate 13 on the bottom face of the base 11 by sticking glue or a double-sided adhesion tape arranged on the binding area 23. A ring-shaped pad 24 is arranged on center of the upper face 21 of the circuit board and is electrically connected with the signal feeder 15. A via hole 25 is formed on the circuit board 2 through which a end 153 of the signal feeder 15 passes. The lower face 22 includes a plurality of first pads 26 is at ground level state under high frequency range with the ground metal plate 13 when the upper face 21 of the circuit board 2 is bound onto the bottom face of the base 11. A ground pad (not shown) can be further arranged on the upper face 21 and electrically connected with the first pads 26 on the lower face 22. When the base 11 is attached onto the upper face 21 of the circuit board 2, the ground metal plate 13 is electrically connected with the ground pad. When the circuit board 2 is electrically connected to a mother board of an electronic device (not shown), the first pads 26 provide both fixing function and grounding function. Besides, a signal feeding trace 27 is arranged on the lower face 22 of the circuit board 2 and has a first end 271 arranged around the through hole 25, and a second end 272 formed as a second pad, wherein the first end 271 is electrically connected with the end 153 of the signal feeder 15 and the second end 272 is used for connecting with a signal feeding end of the mother board. In this embodiment, the signal feeding trace is a planar micro stripe.

Figure 6:
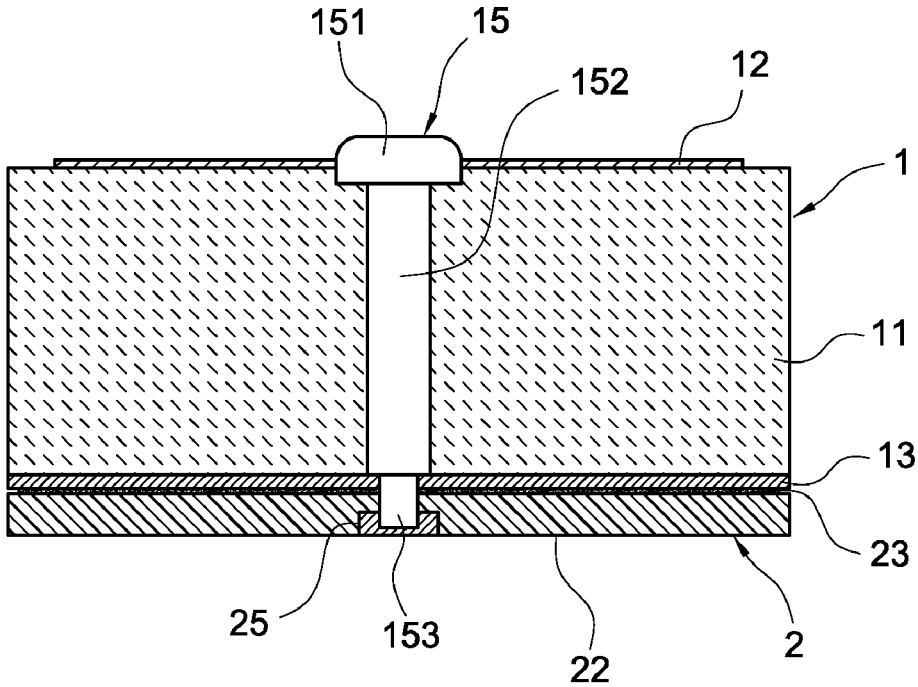
FIG. 6 is a cross-sectional view of a surface mounted planar antenna apparatus of the present invention.

As FIG. 6 shows, when the bottom face of the base 11 of the antenna 1 is attached onto the upper face 21 of the circuit board 2 through sticking glue or a double-sided adhesion tape, the ground metal plate 13 on the bottom face of the base 11 is electrically connected to the binding area 23 of the upper face 21 of the circuit board 2. Then, the rod 152 of the signal feeder 15 of the antenna 1 is passed through the through hole 25 of the circuit board 2 and is electrically connected to the first end 271 of the signal feeding trace 27 to form the surface mounted planar antenna apparatus of the present invention.

Figure 7:
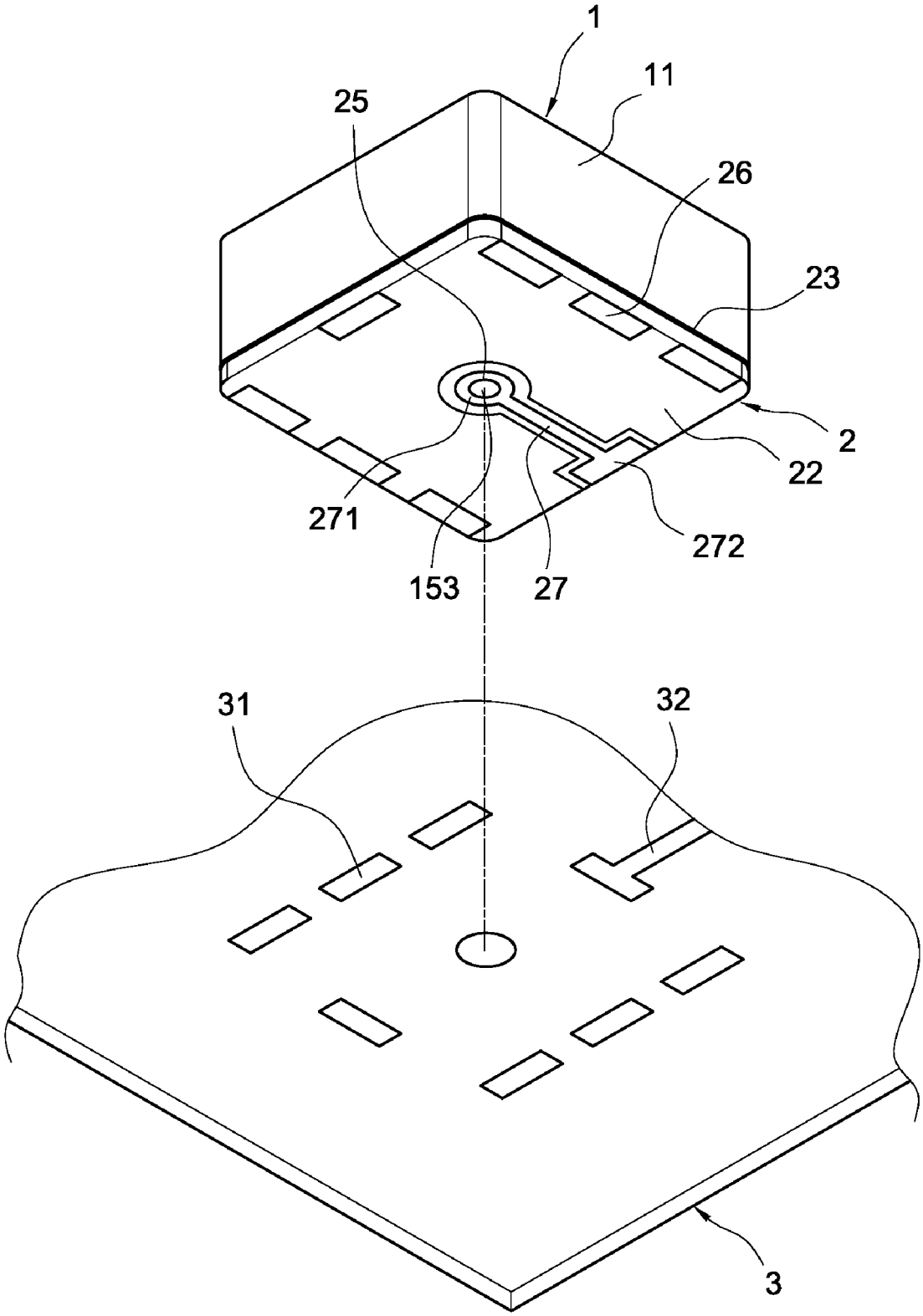
FIG. 7 is a perspective view of a surface mounted planar antenna apparatus of the present invention.
Figure 8:
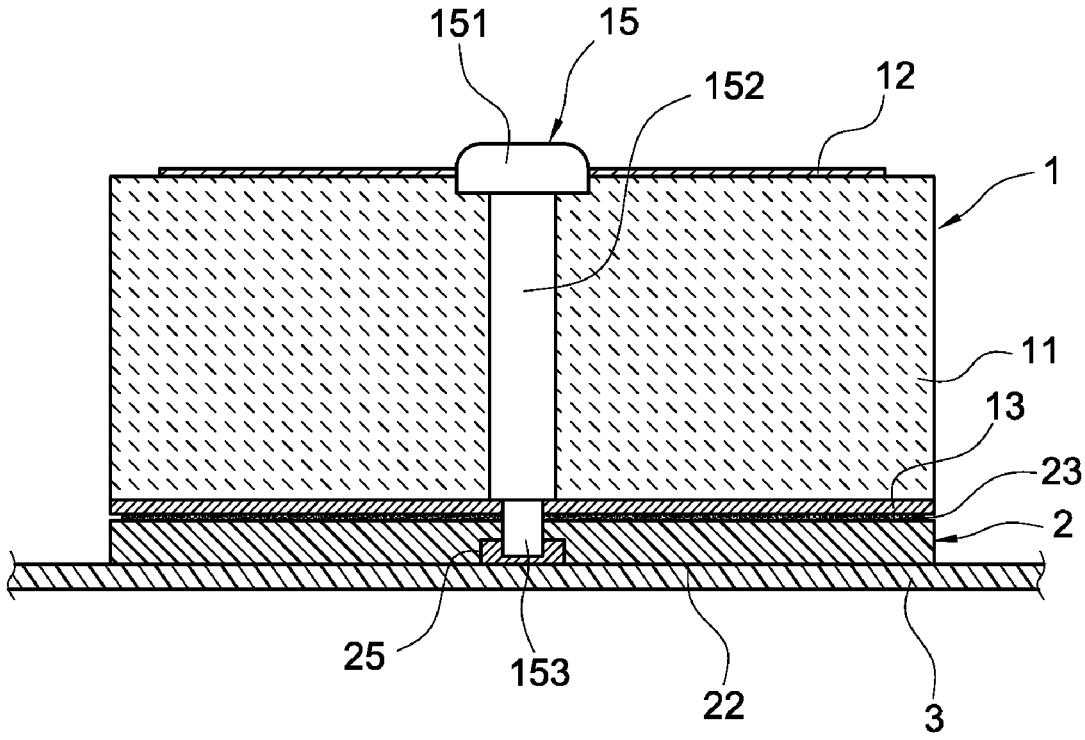
FIG. 8 is a cross-sectional view of a surface mounted planar antenna apparatus of the present invention.

With reference to FIG. 7 and FIG. 8, when the antenna 1 and the circuit board 2 constitute the surface mounted planar antenna apparatus, the first pads 26 on the lower face 22 of the circuit board 2 are electrically connected to a plurality of conducting pads 31 on the mother board 3 of the electronic device. The second pad formed by second end 272 of the signal feeding trace 27 is electrically connected to a signal feeding pad 32 on the mother board 3. Therefore, the surface mounted planar antenna apparatus of the present invention can be mounted onto the mother board 3 of the electronic device using surface mounting techniques, thus tremendously increases the efficiency of assembling of the antenna apparatus and improving the convenience of using the antenna apparatus.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A surface mounted planar antenna apparatus, comprising:

an antenna comprising a base, a radiation metal plate arranged on a top face of the base, and a ground metal plate arranged on a bottom face of the base, a through hole defined from the radiation metal plate and passed through the base to the ground metal plate, the antenna further comprising a signal feeder arranged in the through hole and electrically connected to the radiation metal plate but electrically isolated with the ground metal plate; and a circuit board attached on the bottom face of the base and comprising an upper face, a lower face and a via hole, wherein the upper face includes at least one binding area for binding with the ground metal plate on the bottom face of the base, wherein the lower face includes at least one first pad and a signal feeding trace electrically connected with the signal feeder, and wherein sticking glue or a double-sided adhesion tape is arranged on the binding area for binding with the ground metal plate.

2. The apparatus according to claim 1, wherein the base is made of ceramic material.

3. The apparatus according to claim 1, wherein the signal feeder is of T-shaped and has a semi-circle-shaped head, a rod extended from the head and extended into the through hole to electrically connect the head with the radiation metal plate which is formed as a signal receiving end.

4. The apparatus according to claim 1, wherein a ring-shaped pad is arranged on the upper face of the circuit board and is electrically connected with the signal feeder.

5. The apparatus according to claim 1, wherein a ground pad is arranged on the upper face of the circuit board and is electrically connected with the first pad on the lower face.

6. The apparatus according to claim 1, wherein the signal feeding trace has a first end arranged around the through hole, and a second end formed as a second pad, wherein the first end is electrically connected with the signal feeder and the second end is used for connecting with a mother board.

7. The apparatus according to claim 6, wherein the signal feeding trace is a planar microstrip.

* * * * *